US007571556B2

(12) United States Patent
Hardy et al.

(10) Patent No.: US 7,571,556 B2
(45) Date of Patent: Aug. 11, 2009

(54) HEEL GRID SYSTEM

(75) Inventors: Carl Hardy, Medfield, MA (US); Christopher Mahoney, Westford, MA (US)

(73) Assignee: Saucony, Inc., Lexington, MA (US)

( * ) Notice: Subject to any disclaimer, the term of this patent is extended or adjusted under 35 U.S.C. 154(b) by 418 days.

(21) Appl. No.: 11/435,668

(22) Filed: May 17, 2006

(65) Prior Publication Data

US 2006/0277793 A1 Dec. 14, 2006

Related U.S. Application Data

(63) Continuation-in-part of application No. 11/024,079, filed on Dec. 28, 2004, now Pat. No. 7,441,346.

(51) Int. Cl.
*A43B 13/00* (2006.01)

(52) U.S. Cl. ..... 36/28; 36/37

(58) Field of Classification Search ..... 36/28, 36/35 R, 37

See application file for complete search history.

(56) References Cited

U.S. PATENT DOCUMENTS

| | | | | |
|---|---|---|---|---|
| 2,048,683 | A | 7/1936 | Brockman | |
| 2,402,534 | A | 6/1946 | Crum | |
| 3,822,490 | A | 7/1974 | Murawski | |
| 4,741,114 | A | 5/1988 | Stubblefield | |
| 4,774,774 | A * | 10/1988 | Allen, Jr. | 36/28 |
| 4,878,300 | A * | 11/1989 | Bogaty | 36/35 R |
| 4,878,301 | A * | 11/1989 | Kiyosawa | 36/69 |
| 5,005,299 | A * | 4/1991 | Whatley | 36/25 R |
| 5,070,629 | A * | 12/1991 | Graham et al. | 36/27 |
| D344,174 | S | 2/1994 | Kilgore | |
| D344,398 | S | 2/1994 | Kilgore | |
| D344,399 | S | 2/1994 | Kilgore | |
| D344,400 | S | 2/1994 | Kilgore | |
| D344,401 | S | 2/1994 | Kilgore | |
| D344,622 | S | 3/1994 | Kilgore | |
| D350,018 | S | 8/1994 | Kilgore | |
| D350,019 | S | 8/1994 | Kilgore | |
| D350,020 | S | 8/1994 | Kilgore | |
| D350,225 | S | 9/1994 | Kilgore | |

(Continued)

FOREIGN PATENT DOCUMENTS

WO WO 2006/071511 7/2006

OTHER PUBLICATIONS

International Search Report and Written Opinion from corresponding PCT/US2007/011327 dated Sep. 22, 2008.

*Primary Examiner*—Marie Patterson
(74) *Attorney, Agent, or Firm*—Wolf, Greenfield & Sacks, P.C.

(57) ABSTRACT

An athletic shoe sole construction having a grid system forming a lattice pattern designed to resiliently support a foot and deflect downwardly upon foot imposed forces is provided. The grid system may be located in the heel portion of the shoe. According to some aspects of the invention, the grid system is constructed from a compressible material. In one embodiment, portions of the grid system may be constructed from a foamed material. The athletic shoe includes a midsole arrayed about the periphery of the grid system and extending downwardly therefrom, such that the grid system can deflect and compress into an opening formed by the midsole. A base structure may be provided below the grid system to limit deflection of the grid system into the opening.

19 Claims, 9 Drawing Sheets

U.S. PATENT DOCUMENTS

D350,226 S 9/1994 Kilgore
D350,227 S 9/1994 Kilgore
D350,433 S 9/1994 Kilgore
D351,057 S 10/1994 Kilgore
D351,720 S 10/1994 Kilgore
D351,936 S 11/1994 Kilgore
D352,159 S 11/1994 Kilgore
D352,160 S 11/1994 Kilgore
D354,617 S 1/1995 Kilgore
D355,755 S 2/1995 Kilgore
5,390,430 A 2/1995 Fitchmun et al.
5,402,588 A * 4/1995 Graham et al. ..... 36/28
5,440,826 A 8/1995 Whatley
5,561,920 A * 10/1996 Graham et al. ..... 36/27
5,577,334 A 11/1996 Park
5,595,002 A * 1/1997 Slepian et al. ..... 36/27
D378,012 S 2/1997 Le
5,625,963 A 5/1997 Miller et al.
5,628,128 A 5/1997 Miller et al.
5,647,145 A 7/1997 Russell et al.
5,718,063 A 2/1998 Yamashita et al.
5,729,917 A * 3/1998 Slepian et al. ..... 36/27
5,761,831 A 6/1998 Cho
5,797,199 A 8/1998 Miller et al.
5,839,208 A * 11/1998 Huang ..... 36/28
5,852,886 A * 12/1998 Slepian et al. ..... 36/27
5,860,226 A * 1/1999 Graham et al. ..... 36/28
5,907,911 A 6/1999 Huang
5,974,695 A * 11/1999 Slepian et al. ..... 36/27
5,987,780 A 11/1999 Lyden et al.
6,061,930 A 5/2000 Zinovieff
D429,877 S 8/2000 Lozano et al.
D431,898 S 10/2000 Clegg et al.
D433,216 S 11/2000 Avar et al.
6,195,916 B1 * 3/2001 Meschan ..... 36/37
6,195,918 B1 3/2001 Kelley et al.
6,226,900 B1 5/2001 Mazars
6,233,846 B1 5/2001 Sordi
D446,387 S 8/2001 McCourt
D446,923 S 8/2001 McCourt
D447,330 S 9/2001 McCourt
6,438,873 B1 8/2002 Gebhard et al.
D462,830 S 9/2002 Greene
6,457,261 B1 10/2002 Crary
6,460,275 B1 * 10/2002 Bennett et al. ..... 36/144
6,487,796 B1 12/2002 Avar et al.
6,598,320 B2 7/2003 Turner et al.
6,601,042 B1 7/2003 Lyden
6,601,321 B1 8/2003 Kendall
6,604,300 B2 8/2003 Meschan
6,634,121 B2 10/2003 Sordi
D483,936 S 12/2003 Fullum
D483,937 S 12/2003 Fullum
D485,053 S 1/2004 McDowell
D485,975 S 2/2004 McDowell
6,694,642 B2 2/2004 Turner
6,722,058 B2 4/2004 Lucas et al.
6,729,046 B2 5/2004 Ellis, III
6,769,202 B1 8/2004 Luthi et al.
6,931,765 B2 8/2005 Lucas et al.
2001/0032399 A1 10/2001 Litchfield et al.
2002/0129516 A1 9/2002 Lucas et al.
2002/0144430 A1 10/2002 Schmid
2003/0154628 A1 8/2003 Gyr
2004/0107601 A1 6/2004 Schmid
2004/0168352 A1 9/2004 Lucas et al.
2005/0108898 A1 5/2005 Jeppesen

* cited by examiner

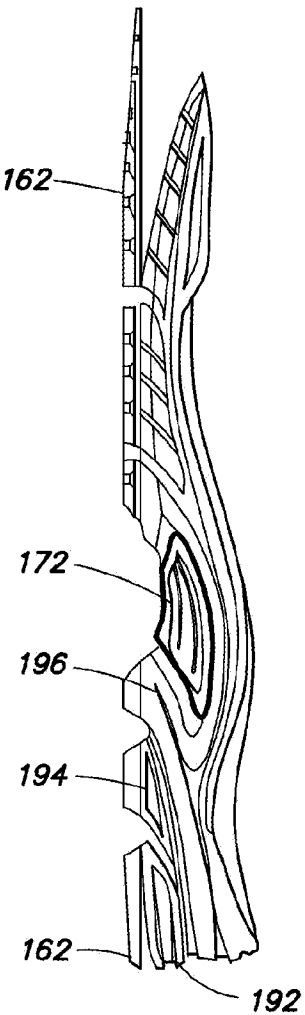
FIG. 5A
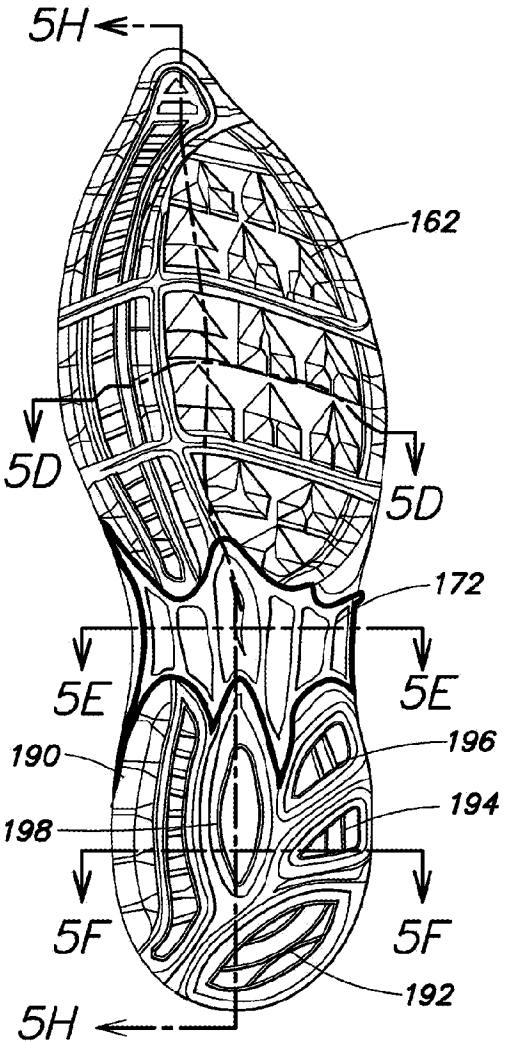
FIG. 5B
FIG. 5C

Comparison of Present Invention to Prior Athletic Shoes

| Shoe Model | Peak Deceleration or "g score" (g) | Energy Returned (%) |
|---|---|---|
| Competitor Shoe with no Grid System | 10.73 | 55.53 |
| Shoe A (with Conventional Grid) | 11.05 | 62.7 |
| Shoe A (with ProGrid™) | 9.51 | 60.39 |
| Competitor Shoe with no Grid System | 12.18 | 50.57 |
| Shoe B (with Conventional Grid) | 12.04 | 60.42 |
| Shoe B (with ProGrid™) | 11.5 | 59.31 |
| Competitor Shoe with no Grid System | 14.1 | 58.7 |
| Shoe C (with Conventional Grid) | 12.41 | 59.79 |
| Shoe C (with ProGrid™) | 10.27 | 56.47 |

FIG. 6

Comparison of Pressure Mapping of Present Invention to a Prior Athletic Shoe

| Shoe Model | Left Foot | Right Foot |
|---|---|---|
| Shoe C (with Conventional Grid) | 62 psi | 58 psi |
| Shoe C (with ProGrid™) | 47 psi | 42 psi |
| Reduced % Impact on Foot with ProGrid™ | 24.20% | 27.60% |

FIG. 7

HEEL GRID SYSTEM

RELATED APPLICATIONS

This application is a continuation-in-part of U.S. application Ser. No. 11/024,079 filed Dec. 28, 2004 now U.S. Pat. No.7441346 entitled SHOE WITH INDEPENDENT SUPPORTS which is herein incorporated by reference in its entirety.

FIELD OF INVENTION

The present invention relates to an athletic shoe construction and more particularly to an athletic shoe having improved cushioning energy return characteristics.

BACKGROUND OF THE INVENTION

Various types of systems have been incorporated into athletic shoes in an attempt to improve upon the energy return characteristics and comfort of the shoe. For example, a cushioning midsole material is commonly incorporated into portions of the sole of an athletic shoe to lessen the impact when the shoe strikes the ground. Other types of athletic shoes have fluid bladders in portions of the sole to cushion the sole. The fluid may be simply air, and sometimes the pressure of the fluid in the bladder may be adjusted by the wearer to alter the cushioning and/or rebounding properties of the shoe.

Another type of energy return system for athletic shoes employs the use of netting or a mesh arrangement in selected portions of the sole construction. For example, U.S. Pat. No. 5,070,629, issued Dec. 10, 1991, discloses an energy return system that includes a rigid frame with a set of monofilaments or fibers secured under tension across the frame. The monofilaments or fibers form a spring-like grid system that stores energy during the compression portions of the gait cycle and releases energy during the push-off phase of the gait cycle. U.S. Pat. No. 5,402,588, issued Apr. 4, 1995, U.S. Pat. No. 5,561,920, issued Oct. 8, 1996, U.S. Pat. No. 5,595,002, issued Jan. 21, 1997, U.S. Pat. No. 5,852,886, issued Dec. 29, 1998, U.S. Pat. No. 5,974,695, issued Nov. 2, 1999, and U.S. patent application Ser. No. 10/723,977, filed Nov. 26, 2003, disclose various improvements to this spring-like energy return system, all of which are herein incorporated by reference in their entirety.

It is an object of the present invention to provide an improved energy return and cushioning system for a shoe.

SUMMARY OF INVENTION

According to one aspect of the invention, an athletic shoe construction is provided which includes a grid system located in the heel portion. The grid system forms a lattice pattern designed to resiliently support a foot and deflect downwardly upon foot imposed forces, and the grid system is constructed from a foamed material. The shoe construction further includes a midsole defining an opening, where the midsole is arrayed about the periphery of the grid system and extending downwardly therefrom, such that the grid system can deflect into the opening formed by the midsole.

In another aspect of the invention, an athletic shoe construction is provided which includes a grid system located in the heel portion. The grid system forms a lattice pattern designed to resiliently support a foot and deflect downwardly upon foot imposed forces, and the grid system is compressible. The shoe construction further includes a midsole defining an opening, where the midsole is arrayed about the periphery of the grid system and extending downwardly therefrom, such that the grid system can deflect and compress into the opening formed by the midsole.

In yet another aspect of the invention, an athletic shoe construction is provided which includes a grid system formed by a resilient web with a reinforcing lattice structure. The grid system is designed to resiliently support a foot and deflect downwardly upon foot imposed forces, and the lattice structure is constructed from a compressible material. The shoe construction further includes a midsole defining an opening, where the midsole is arrayed about the periphery of the grid system and extending downwardly therefrom, such that the resilient web and lattice structure can deflect and compress into the opening formed by the midsole.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing.

Various embodiments of the invention will now be described, by way of example, with reference to the accompanying drawings, in which:

FIG. 5A is a medial side view of an athletic shoe sole construction according to one embodiment;

FIG. 5B is a bottom view of the athletic shoe sole construction illustrated in FIG. 5A;

FIG. 5C is a lateral side view of the athletic shoe sole construction illustrated in FIGS. 5A-5B;

FIG. 6 is a chart illustrating experimental results which compare a shoe according to certain embodiments of the present invention with prior athletic shoes;

FIG. 7 is a chart illustrating experimental results which compare pressure mapping of a shoe according to one embodiment of the present invention with a prior athletic shoe;

DETAILED DESCRIPTION

Aspects of the invention are directed to a shoe sole construction having an improved energy return and cushioning system. The energy return system of the present invention includes the use of components in the midsole that may provide both cushioning and energy return characteristics. These components may be selectively employed in the heel, midfoot, and/or forefoot portions to provide the desired energy return characteristics for a particular type of shoe. These components may be especially designed for use in athletic shoes such as walking shoes, cross-training shoes, basketball shoes, and running shoes. In one embodiment an energy return system with improved cushioning properties is provided.

In one embodiment, the design of an athletic shoe sole includes a grid system located in the heel portion of the shoe. The grid system may be designed to resiliently support a foot and deflect upon foot imposed forces. In other embodiments, it is also contemplated that the grid system may be located in other portions of the shoe, such as the midfoot and forefoot portions. The grid system of the present invention may be constructed from a foamed material. As described in greater detail below, a grid system constructed from a foamed material may exhibit beneficial cushioning and energy return characteristics. In one embodiment, the shoe sole is designed to minimize the amount of material and or weight of the shoe sole, while also maximizing the amount of desirable deflection of the grid system. Furthermore, according to certain embodiments of the present invention a compressible grid system is provided.

Figure 2:
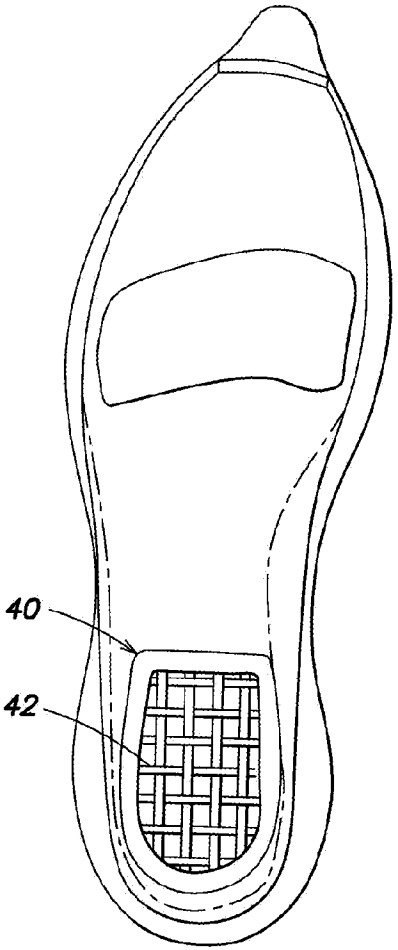
FIG. 2 is a top view of a partial length midsole insert with a heel grid system according to one embodiment of the present invention.
Figure 1B:
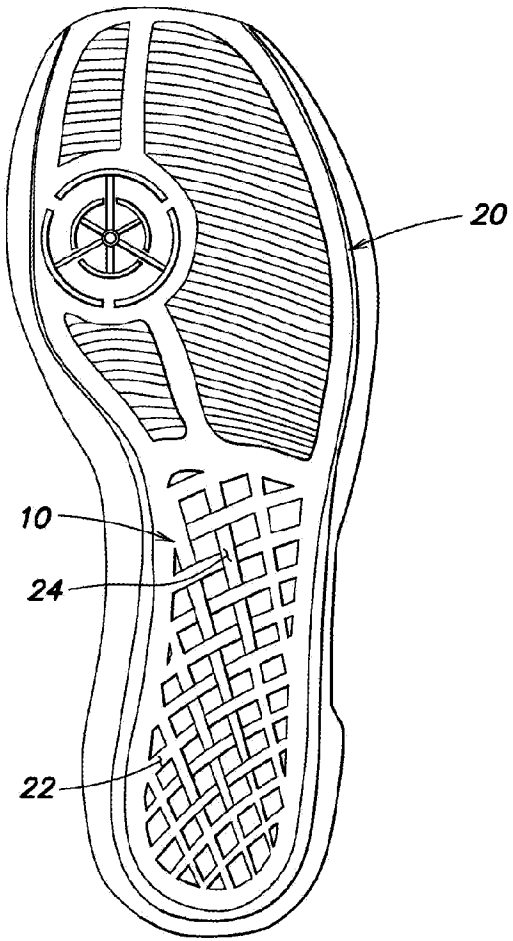
FIG. 1B is the bottom view of one embodiment of the midsole insert illustrated in FIG. 1A.
Figure 1A:
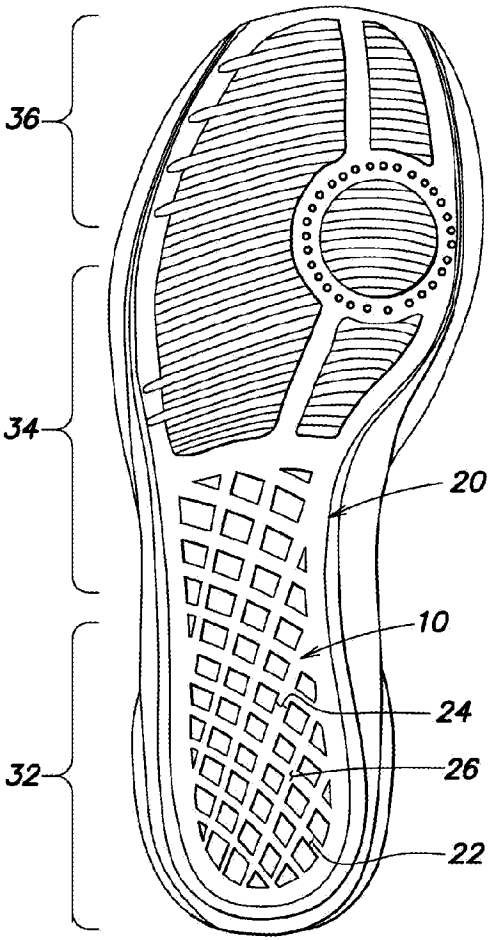
FIG. 1A is a top view of a full length midsole insert with a heel grid system according to one embodiment of the present invention.

Turning to the drawings, FIGS. 1A and 1B illustrate the top and bottom view of one embodiment of a midsole insert 20, with a grid system 10 formed into the insert 20. This particular midsole insert 20 is full length, extending from the heel portion 32 to the midfoot portion 34 and to the forefoot portion 36. However, it is also contemplated that in some embodiments, the midsole insert is not full length. For example, as illustrated in FIG. 2, a midsole insert 40 is provided with a grid system 42 formed into the insert 20, where the insert extends only within the heel portion 32. The grid system 10, 42 may extend within the heel portion 32, the midfoot portion 34 and the forefoot portion 36. In the embodiment of FIG. 1, the grid system 10 extends from the heel into the midfoot, whereas in the embodiment of FIG. 2, the grid system 42 extends only in the heel portion.

In contrast to prior grids, aspects of the present invention include a grid system constructed from a foamed material. Aspects of the invention are directed to preserving the energy return performance of a shoe while also improving upon the cushioning performance of the shoe. Various types of foamed materials are described in greater detail below. As discussed in greater detail below, in other embodiments, the grid system is constructed from a compressible material. The compressible material may provide cushioning properties, and in one embodiment, the compressible material may be a foamed material.

The grid system 10, 42 may be formed into the midsole insert 20, 40 in different manners. The grid system may be molded into the insert, the grid system may be co-molded, integrally formed, or the grid system may be formed separately from the rest of the insert and then positioned within an opening in the insert. Portions or all of the grid system may include a weave pattern as illustrated in FIG. 1B.

In one embodiment, the grid system 10 is made up of a first set of fibers 22 crossing a second set of fibers 24. The two sets of fibers 22, 24 may be integrally connected at their intersections 26 (such as when they are both integrally molded with a portion of the midsole insert 20), one may simply lie across the other, or they may be wholly or partially interwoven. The fibers 22, 24 in the grid system are suitably taut, thereby forming a spring-like member which is resilient. Therefore, the grid system 10 is capable of deflection and return when impacted by the force of the heel of the foot. The grid system may function as a spring-like system in selected areas of the midsole insert 20 for the purpose of storing energy in running and/or jumping during compression portions of the gait cycle and for releasing energy during the push-off phase of the gait cycle.

As shown in FIGS. 1-2, the two sets of fibers 22, 24 intersect to form a 90° angle. However, the fibers may also cross each other at different angles. It is also contemplated that the grid system is formed with more than two sets of fibers.

The grid system of the present invention may be constructed from a variety of different types of foamed materials. In certain embodiments, the grid insert material is a lightweight material having a cellular form due to the introduction of gas bubbles during the manufacture process. In one embodiment, the grid system is ethylene-vinyl acetate (EVA) based. In other embodiments, polyurethane and/or thermoplastic rubber (TPR) may be used to make the grid system. In one embodiment, an EVA based material is used to construct the grid system, where the material is known as a super power cushioning material (SPC) obtained from SanYu Corporation, located in NanHai, China. Material testing illustrated that this particular EVA based material exhibited increased rebounding or energy return characteristics in comparison to standard EVA. In one embodiment, this particular new material may be known as RESPOND-TEK™.

FIGS. 3-5 illustrate a variety of views for three different embodiments of a shoe sole which features the grid system of the present invention. In particular, in the embodiment illustrated in FIGS. 3A-3H, a midsole insert 50 having a grid system 80 located in the heel portion is provided. As shown in FIG. 3H, in the forefoot portion, the full length midsole insert 50 is positioned above additional midsole components 60 and an outsole 62. As shown in FIGS. 3A-3C, the outsole 62 may have a rugged pattern to provide traction. Also, as shown in FIG. 3B, the heel portion of the shoe may include an opening 96 formed by the midsole such that the grid system can deflect into the opening 96. As explained in greater detail below, in one embodiment, this opening 96 is formed by a midsole arrayed about the periphery of the grid system 80.

Figure 3C:
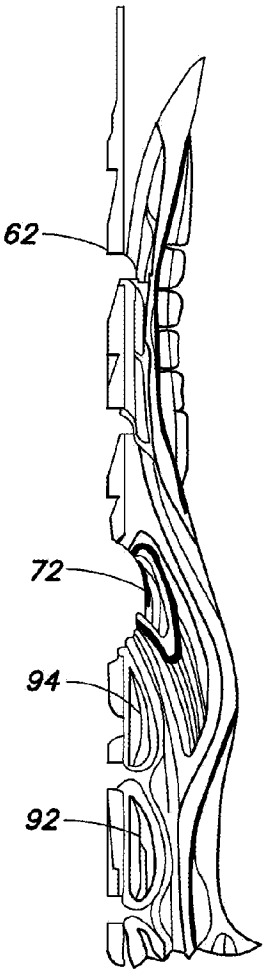
FIG. 3C is a lateral side view of the athletic shoe sole construction illustrated in FIGS. 3A-3B.
Figure 3B:
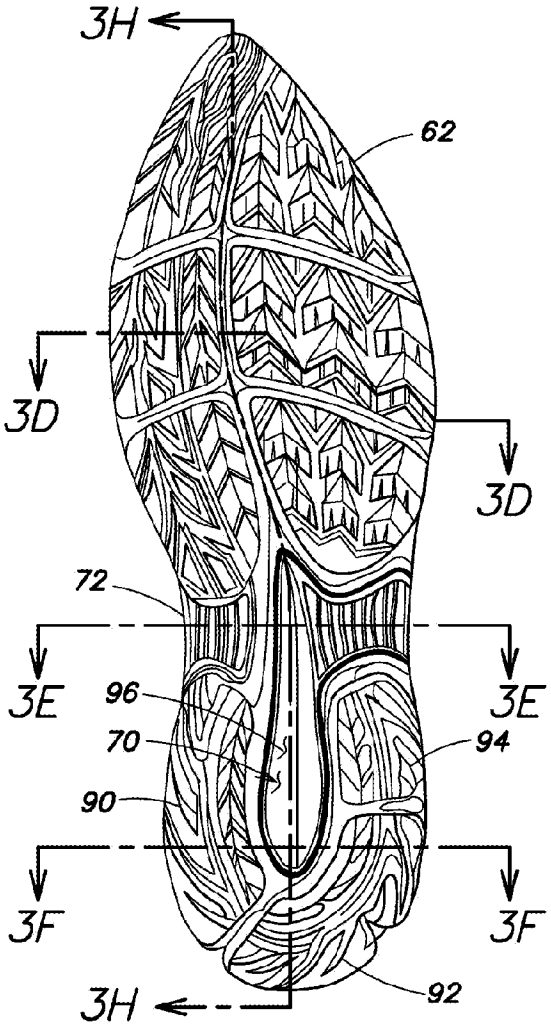
FIG. 3B is a bottom view of the athletic shoe sole construction illustrated in FIG. 3A.
Figure 3A:
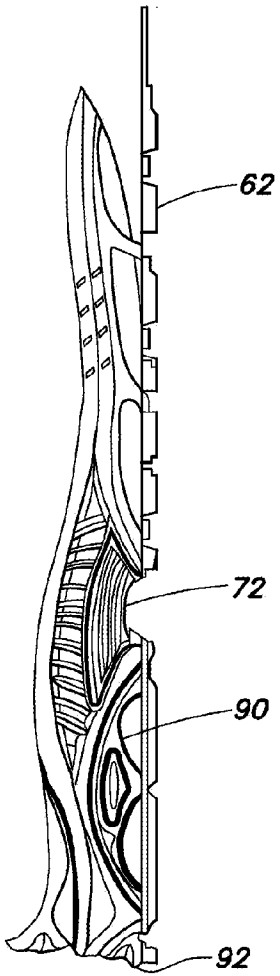
FIG. 3A is a medial side view of an athletic shoe sole construction according to one embodiment.
Figure 3H:
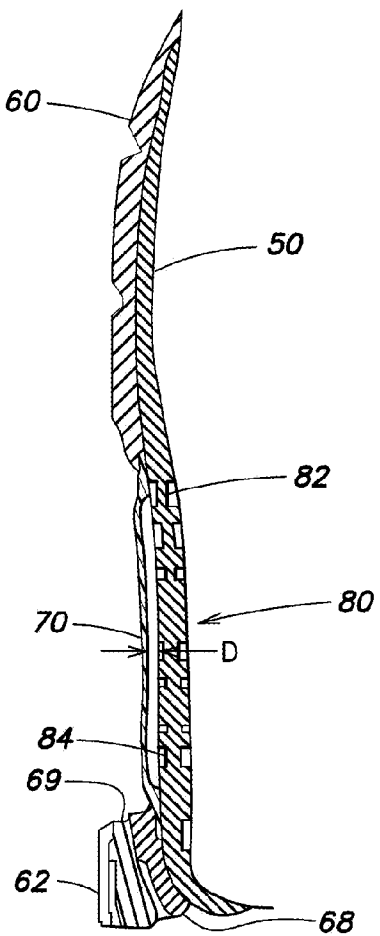
FIG. 3H is a cross-sectional view of the shoe sole taken along the line 3H-3H of FIG. 3B.
Figure 3G:
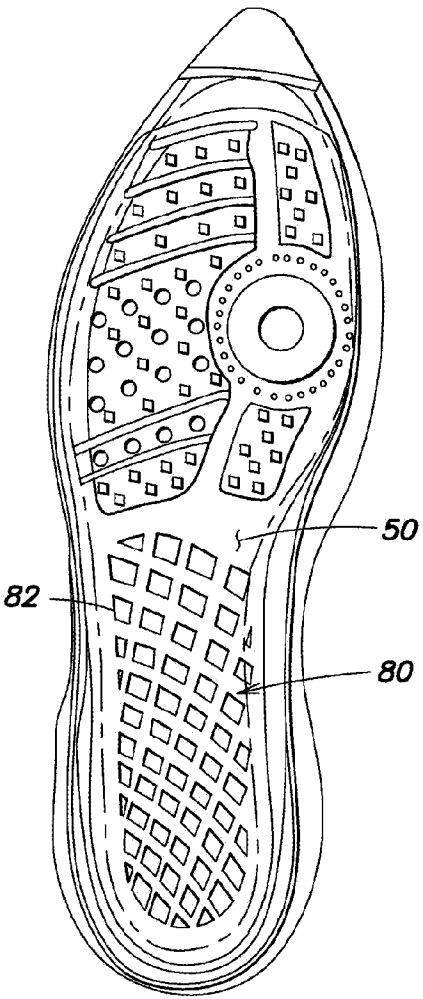
FIG. 3G is a bottom view of the shoe sole illustrated in FIGS. 3A-3C.
Figure 3D:
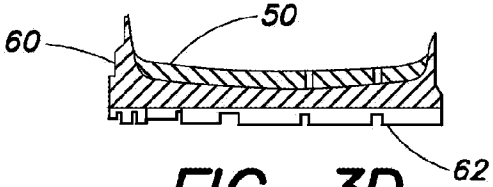
FIG. 3D is a cross-sectional view of the shoe sole taken along the line 3D-3D of FIG. 3B.

The grid system 80 is similar to the above-described grid systems, and as shown in FIGS. 3G and 3H, includes a plurality of openings 82, 84 which are formed as the space in between the fibers 22, 24 which form a lattice pattern. The lattice pattern and openings 82, 84 may be formed into both an upper surface and a lower surface of the midsole insert 50 as shown in FIG. 3H. It should be appreciated that in some embodiments, the lattice pattern may be formed into only one side of the insert 50. In yet other embodiments, the openings 82, 84 may extend through the midsole insert 50, such that the lattice pattern of the grid system extends through the entire thickness of the midsole insert 50.

As discussed above, the grid system provides desirable energy return characteristics. Furthermore, when the grid system is constructed from a foamed material, it also provides desirable cushioning characteristics. The grid system 50 may be designed to resiliently support a foot and deflect upon foot imposed forces. As explained in greater detail below, according to certain embodiments, the grid system may be constructed from a compressible material. The use of a compressible material may provide additional cushioning properties to the shoe.

Figure 3E:
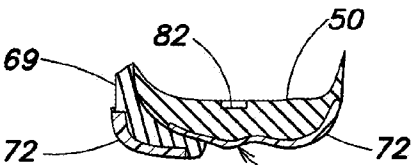
FIG. 3E is a cross-sectional view of the shoe sole taken along the line 3E-3E of FIG. 3B.
Figure 3F:
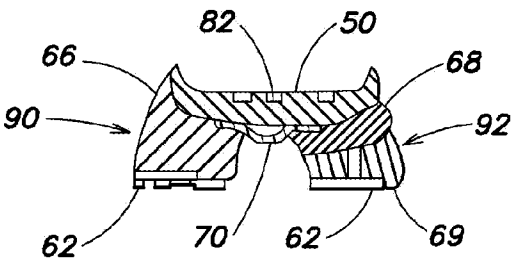
FIG. 3F is a cross-sectional view of the shoe sole taken along the line 3F-3F of FIG. 3B.

According to certain embodiments, the deflection of the grid system may be limited by a base structure 70. The base structure 70 is positioned below portions of the grid system 50. The base structure 70 may extend into the opening 96 formed by the midsole. As shown in FIG. 3H, the base structure may extend substantially across the grid system 80, and portions of the base structure 70, such as the end portions, may be positioned within portions of the midsole components 60, 68. The base structure 70 may be spaced apart from at least a portion of the grid system 80. For example, in FIG. 3H, the base structure 70 is offset from the grid system 80 by a distance D. In one embodiment, this distance D may be approximately 1 mm, 2 mm, 3 mm, 4 mm, 5 mm, 6 mm, 8 mm, or 10 mm. However, in other embodiments, the offset distance may vary. As shown in FIGS. 3E and 3F, the offset distance D illustrated in FIG. 3H may be a maximum offset distance, depending upon the shape of the base structure 70. As shown in FIGS. 3E and 3F, the base structure 70 has a curved shape within the opening 96, therefore the offset distance D may vary across the width of the shoe. It should be appreciated that in other embodiments, the base structure 70 may be substantially planar.

As mentioned above, the base structure may be positioned to limit the deflection of the grid system into the opening. In one embodiment, the base structure 70 may be constructed from a material that is more rigid than the material which forms the grid system 80. In one embodiment, the base structure 70 is formed of a substantially incompressible material, and in one embodiment, the base structure 70 is formed of a non-foamed material. Various types of materials may be used to form the base structure, such as different types of thermoplastic materials, like thermoplastic polyurethane (TPU), or ethylene based compounds such as ESS.

The midsole arrayed about the periphery of the grid system in the heel portion of the shoe sole may be configured in a variety of ways. In one embodiment, as shown in the embodiment of FIG. 3, the midsole includes a plurality of independent supports 90, 92 and 94 arrayed about the periphery of the grid system 80. These supports may include a ground engaging outsole 62 and a resilient section 66, 68 and 69 intermediate the ground engaging section and the grid system 80, where the supports 90, 92 and 94 may collectively provide a flexible resilient support for the grid system 80. As illustrated in FIG. 3B, each independent support 90, 92 and 94 has a ground engaging section distinct from the ground engaging section of an adjacent support. In this respect, one support may deflect independently of an adjacent support. Although three supports are illustrated in FIG. 3B, it should be appreciated that in other embodiments, two or more supports may be arrayed about the periphery of the grid system 80. Additionally, the midsole positioned below and around the grid system may be constructed from a variety of materials, including EVA and SRC (Super Rebound Compound) which is an EVA/rubber compound. In some embodiments, several types of materials may be incorporated into the midsole. These materials may vary in density, rigidity, and resiliency. For example, as shown in FIGS. 3F and 3H, support 92 may include a first midsole material 68 adjacent to a second midsole material 69. The outsole 62 may be made of a carbon rubber outsole material.

The shoe sole may also include a supporting structure 72 in the midfoot region. One example of a supporting structure 72 is illustrated in FIGS. 3A-3C and 3E. This structure may be made from a material similar to the base structure 70 and may provide support to the arch of the foot. This supporting structure 72 may extend along both the medial and lateral sides of the shoe and it is also contemplated that portions or all of the supporting structure 72 are formed with portions or all of the base structure 70. For example, as illustrated in FIG. 3E, one side of the supporting structure 72 is formed with the base structure. The supporting structure 72 may be constructed from a thermoplastic materials, such as TPU.

Figure 4C:
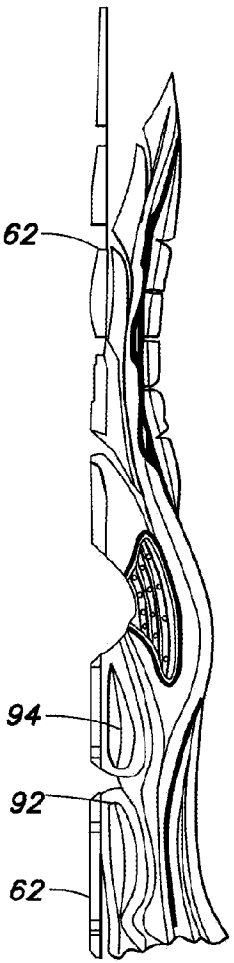
FIG. 4C is a lateral side view of the athletic shoe sole construction illustrated in FIGS. 4A-4B.
Figure 4B:
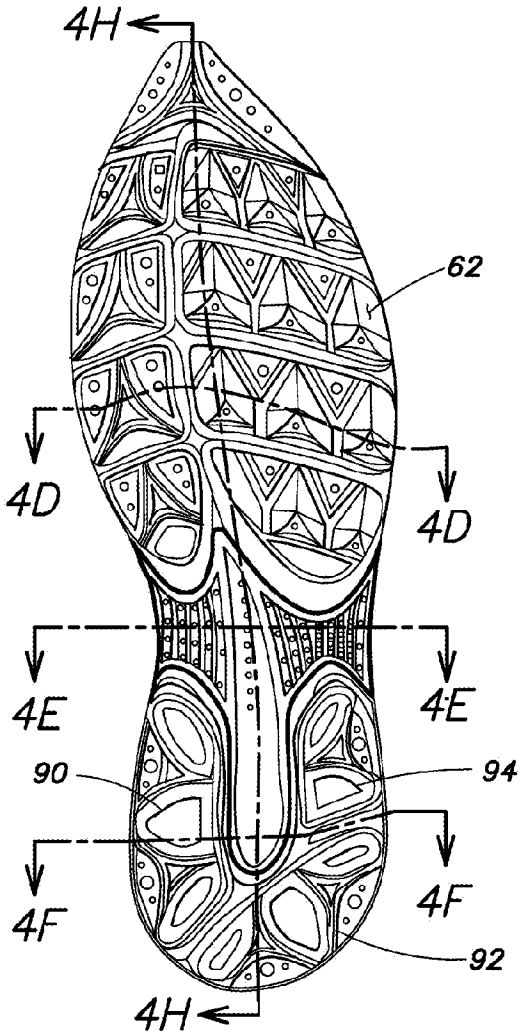
FIG. 4B is a bottom view of the athletic shoe sole construction illustrated in FIG. 4A.
Figure 4A:
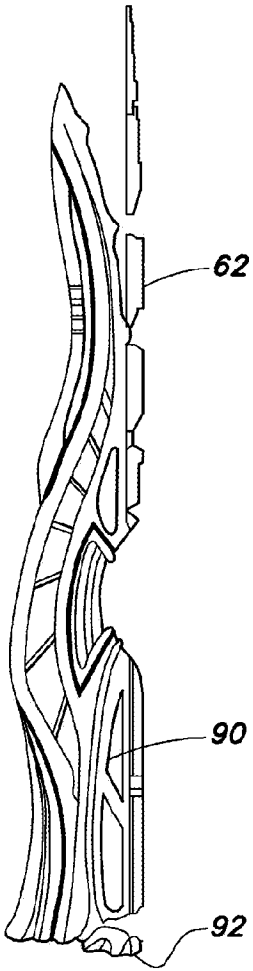
FIG. 4A is a medial side view of an athletic shoe sole construction according to one embodiment.
Figure 4H:
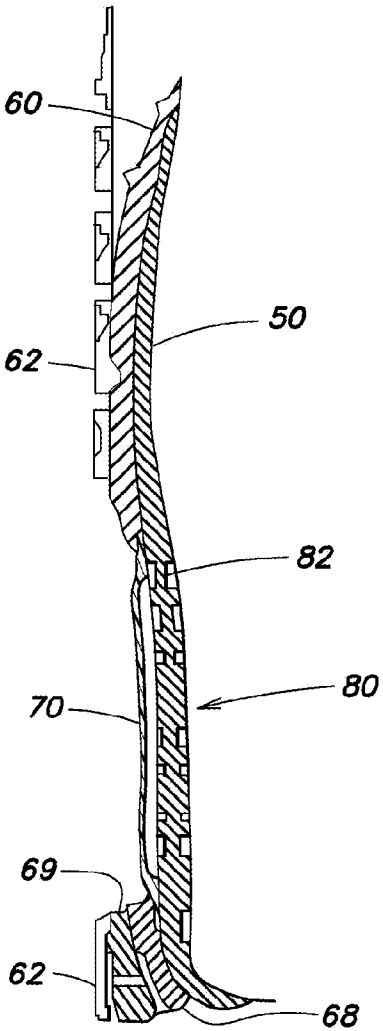
FIG. 4H is a cross-sectional view of the shoe sole taken along the line 4H-4H of FIG. 4B.
Figure 4G:
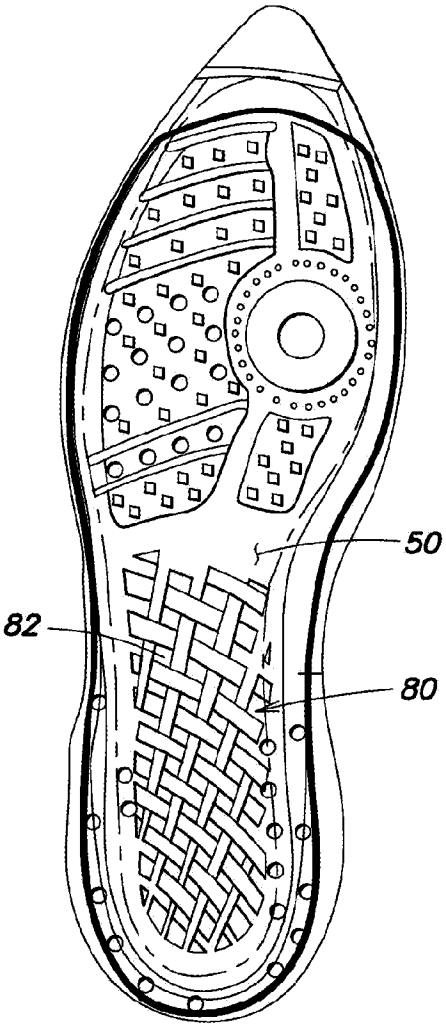
FIG. 4G is a bottom view of the shoe sole illustrated in FIGS. 4A-4C.
Figure 4D:
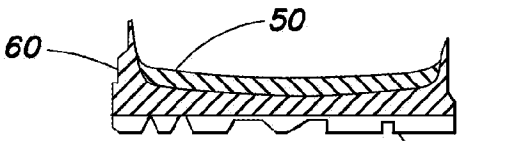
FIG. 4D is a cross-sectional view of the shoe sole taken along the line 4D-4D of FIG. 4B.
Figure 4E:
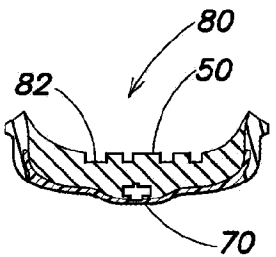
FIG. 4E is a cross-sectional view of the shoe sole taken along the line 4E-4E of FIG. 4B.
Figure 4F:
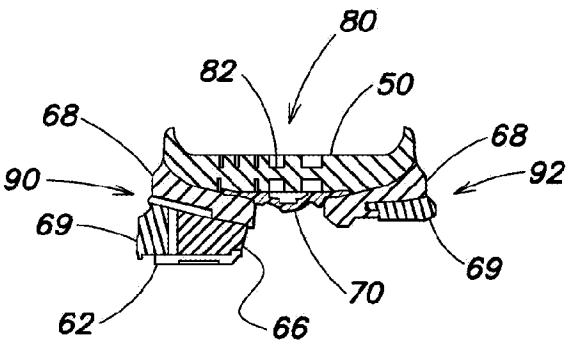
FIG. 4F is a cross-sectional view of the shoe sole taken along the line 4F-4F of FIG. 4B.

The embodiment illustrated in FIGS. 4A-4H is similar to the embodiment of FIGS. 3A-4H, and similar components have been labeled with identical reference numbers. As shown, a full length midsole insert 50 is provided with a grid system 80 located in the heel portion. Like FIG. 3, the embodiment shown in FIG. 4 includes a plurality of independent midsole supports 90, 92 and 94. The cross-sectional view of FIG. 4F illustrates the separation distance between two adjacent supports, 92 and 94 which allows one support to deflect independently of an adjacent support. As shown, the cross-sectional cut of FIG. 4F is taken in between these two supports which illustrates that the ground engaging section of one support is distinct from the ground engaging section of an adjacent support.

Furthermore, as mentioned above, the base structure 70 may extend up into the midfoot portions of the shoe to form a supporting structure for the arch region of the foot. As shown in FIG. 4E, the base structure 70 may have a generally U-shape, extending upwardly on the medial and lateral side of the shoe.

FIGS. 5A-5H illustrate yet another embodiment of a grid system according to the present invention. In FIG. 5, a midsole insert 150 is provided with a grid system 180 formed into the insert 150, where the insert 150 extends only within the heel portion. As shown, the midsole insert 150 is incorporated into portions of the midsole 160 of a shoe sole, and a conventional outsole 162 may be the ground engaging surface. Similar to the above discussed embodiments, a base structure 170 may be positioned below the grid system 180, extending into the opening 198 formed by the midsole in the heel portion of the shoe. The base structure 170 may be positioned to limit the deflection of the grid system 180 into the opening 198, and the base structure 170 may be spaced apart from at least a portion of the grid system 180. As shown in the embodiment in FIGS. 5F and 5H, portions of the base structure 170 are spaced apart from the grid system 180. In particular, the base structure may be substantially parallel to portions of the grid system 180, while a portion of the base structure, such as the center portion, may be offset from the grid system. This section may provide a maximum downward deflection distance for the grid system. It should be appreciated, that in some embodiments, the base structure 170 may be constructed from a material which may exhibit some deflection upon foot imposed forces. In such circumstances, the maximum downward deflection of the grid system 180 may be greater than the offset distance between the grid system 180 and the base structure 170 due to the deflection of the base structure 170. However, it should be appreciated that in other embodiments, the base structure may be constructed from a substantially non-deflectable material. Furthermore the grid system may be provided without a base structure positioned below to limit deflection.

In embodiments where the midsole insert 150 with a grid insert 180 is not full length, an additional insert 174 may be provided in the forefoot portion of the shoe. This insert 174 may be constructed from the same or similar compressible and/or foamed material as the insert 150 and may provide additional cushioning properties to the ball of the foot.

Figure 5H:
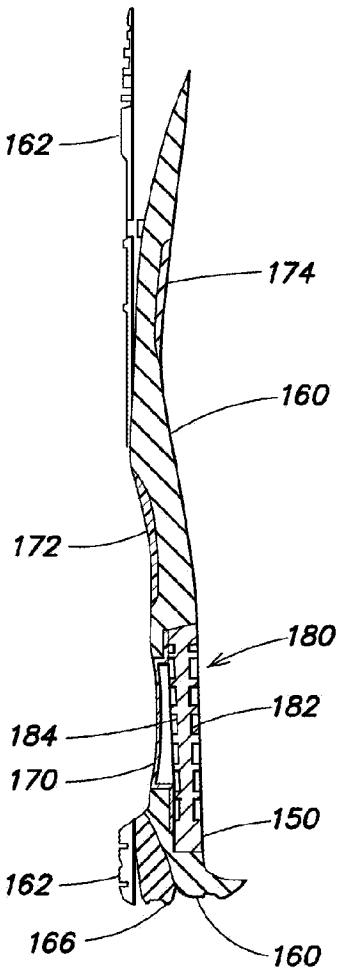
FIG. 5H is a cross-sectional view of the shoe sole taken along the line 5H-5H of FIG. 5B.
Figure 5G:
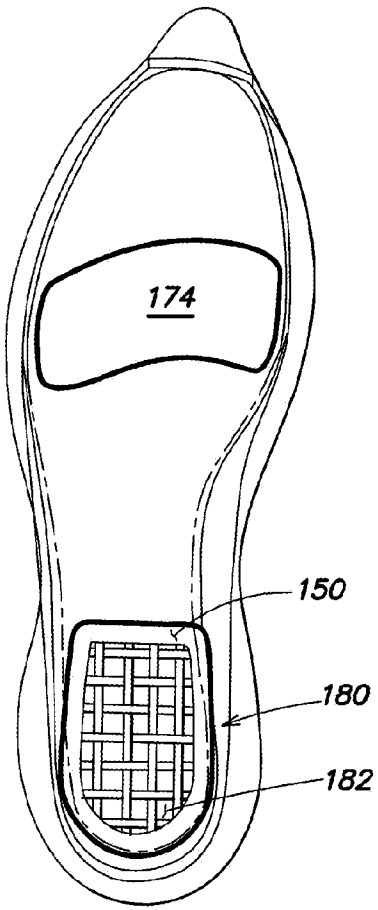
FIG. 5G is a bottom view of the shoe sole illustrated in FIGS. 5A-5C.
Figure 5D:
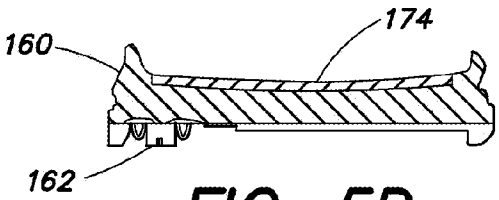
FIG. 5D is a cross-sectional view of the shoe sole taken along the line 5D-5D of FIG. 5B.
Figure 5E:
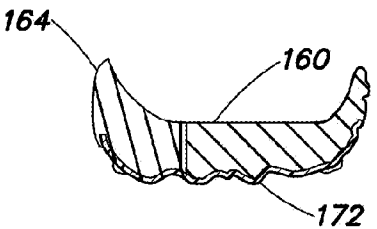
FIG. 5E is a cross-sectional view of the shoe sole taken along the line 5E-5E of FIG. 5B.
Figure 5F:
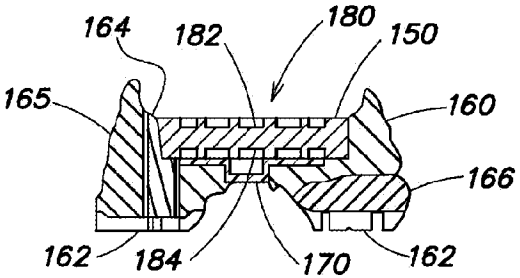
FIG. 5F is a cross-sectional view of the shoe sole taken along the line 5F-5F of FIG. 5B.

As mentioned above, in some embodiments, the base structure 170 extends up into the midfoot portions of the shoe to form a supporting structure for the arch region. However, in other embodiments, such as illustrated in FIGS. 5E and 5H, a separate supporting structure 172 cradles the arch region in the midfoot portion of the shoe sole and the base structure 170 extends only within the heel portion.

Another distinguishing feature illustrated in the embodiment disclosed in FIG. 5 is that the midsole arrayed about the periphery of the grid system 180 in the heel portion of the shoe sole includes four supports 190, 192, 194 and 196 (see FIG. 5B) rather than three as described above. As shown, these supports may be constructed of various types of midsole materials 160, 164, 165, 166. Furthermore, each support has a ground engaging section which is distinct from the ground engaging section of an adjacent support.

Aspects of the present invention are directed to an energy return grid system which may be positioned closer to the foot. In conventional shoe designs that feature some sort of grid system, additional cushioning layers may separate the grid system from the foot. In certain shoe designs, this was done because the grid system itself did not have sufficient cushioning properties. However, by incorporating a foamed cushioning material into the grid system itself, some or all of these additional layers may be removed from the shoe design. This arrangement of the present invention may maximize reaction time and overall performance.

As mentioned above, aspects of the present invention are directed to a shoe sole construction which features desirable energy return characteristics with improved cushioning capabilities. As illustrated in FIGS. 6 and 7, experimental results indicate that certain embodiments of the present invention achieve desirable energy return characteristics while also providing an increased amount of cushioning to the foot.

Often, the greater the energy return in a shoe, the less cushioning in the shoe. Therefore, some of the prior shoe designs which featured strong energy return characteristics either lacked in cushioning properties, or featured additional materials to provide cushioning. However, according to the present invention, with the right shoe structure and a proper blend of materials, a desirable balance of both energy return and cushioning may be achieved.

FIG. 6 illustrates both the Peak Deceleration or "g score" and Percentage Energy Returned for several shoes. The Peak Deceleration or "g score" is a measurement of the cushioning properties of a shoe. The lower the score, the better the cushioning. In contrast, Percentage Energy Return indicates the percentage of the impact returned in a shoe. A theoretical value of 100% energy return would indicate that all of the energy that impacts in a downward direction when the foot strikes the ground would be returned in an upward direction to release energy during the push-off phase of the gait cycle. In essence, the percentage energy return may be a measure of the resiliency or spring-like behavior of the shoe. The higher the percentage energy return, the greater the spring-like deflection behavior of the shoe.

FIG. 6 is broken down into three categories. The top portion compares Shoe A to a competitor shoe having no grid system. Two versions of Shoe A were tested; one version having a convention grid system and one version being a new shoe, Shoe A with ProGrid™. ProGrid™ refers to one embodiment of the present invention grid system constructed from a compressible foamed material. Shoe A with a conventional grid is a shoe model with a conventional grid system. As shown, the conventional Shoe A provided more energy return than the competitor shoe, yet the peak deceleration was slightly higher for Shoe A, which indicates that Shoe A did not have as much cushioning properties as the competitor. In contrast, Shoe A with ProGrid™ features both higher energy return and more cushioning (lower g score) in comparison to the competitor shoe. Shoe A with ProGrid™ may be constructed similar to the embodiment illustrated in FIGS. 4A-4H.

FIG. 6 also compares another shoe model, Shoe B (both with a conventional grid system and also with the new ProGrid™) with its competitor shoe. Shoe B with ProGrid™ may be constructed similar to the embodiment illustrated in FIGS. 3A-3H. As shown, Shoe B with a conventional grid system returns more energy than its competitor and has slightly more cushioning than its competitor. Shoe B with ProGrid™ also returns more energy than the competitor shoe and provides even more cushioning than either shoe.

The bottom portion of FIG. 6 illustrates the experimental results of the tests which compare Shoe C (both with a conventional grid system and also with the new ProGrid™) with a competitor shoe having no grid system. Shoe C with ProGrid™ may be constructed similar to the embodiment illustrated in FIGS. 5A-5H. Shoe C with the conventional grid returns a greater percentage of energy in comparison to the competitor shoe and also features a lower g score, which translates into greater cushioning properties. Shoe C with ProGrid™ also returns a greater percentage of energy in comparison to the competitor shoe and features an even lower g score. Thus, Shoe C with ProGrid™ provides an even better cushioning performance. As the above described data illustrates, aspects of the present invention are directed to a shoe sole construction which exhibits energy return characteristics with improved cushioning properties.

FIG. 7 also illustrates experimental results directed to pressure testing of Shoe C with a conventional grid system in comparison to Shoe C with ProGrid™. This data indicates the peak pressure point value for both a left foot and a right foot while wearing Shoe C with a conventional grid system and also while wearing Shoe C with ProGrid™. The pressure mapping indicates that ProGrid™ absorbs at least approximately 25% more impact in comparison to a prior conventional grid. This impact reduction provides 25% less shock absorbed by the runner's body.

As mentioned above, aspects of the present invention are directed to a compressible grid system. Thus, according to certain embodiments, a grid system may be provided that is both deflectable and compressible. In contrast, prior grid systems were of a more rigid construction and were substantially incompressible. According to the present invention, the deflection of the grid system may provide energy return while the compressibility of the grid system may provide the desirable cushioning properties.

Figure 8:
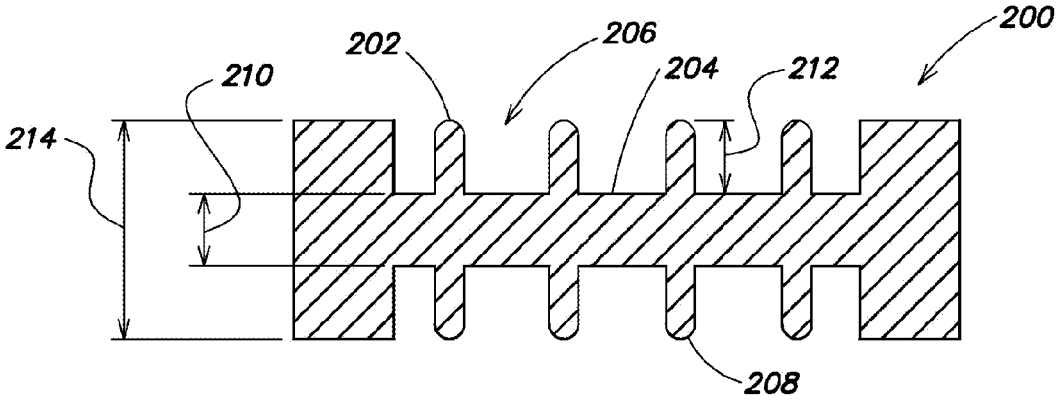
FIG. 8 is a cross-sectional view of one embodiment of a midsole insert with a heel grid system.
Figure 9:
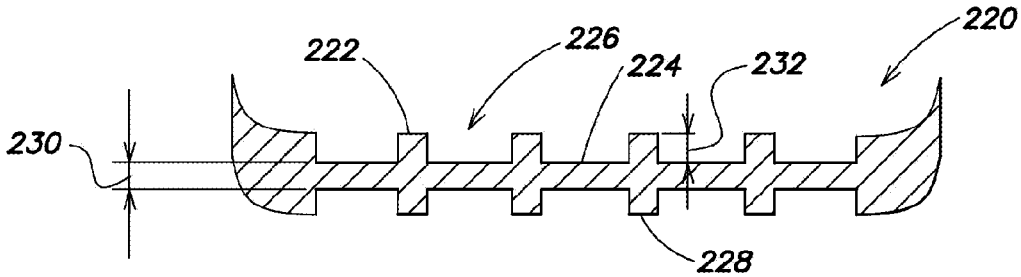
FIG. 9 is a cross-sectional view of another embodiment of a midsole insert with a heel grid system.

FIGS. 8 and 9 illustrate cross-sectional views of two embodiments of a midsole insert 200, 220 having compressible grid systems 206, 226. As shown, the grid systems 206, 226 may be formed by a resilient web 204, 224 with a reinforcing lattice structure 202, 222. As discussed above, the grid system may be designed to resiliently support a foot and deflect downwardly upon foot imposed forces. In the embodiments illustrated in FIGS. 8 and 9, the reinforcing lattice structure 202, 222 is constructed from a compressible material. In this particular embodiment, the resilient web 204, 224 is integrally formed with the reinforcing lattice structure 202, 222, however, it should be appreciated that in other embodiments (not shown), the lattice structure may be formed separately from the resilient web. While in some embodiments, only the lattice structure may be compressible, in other embodiments, the resilient web may also be compressible.

As mentioned above, the grid systems 206, 226 illustrated in FIGS. 8 and 9 are compressible. Thickness 214 illustrated in FIG. 8 represents the overall thickness of the grid system 206 in a decompressed state. During a typical gait cycle, when downward forces are exerted on a foot, the grid system 206 may be compressed such that the thickness of the grid system 206 would be less than the decompressed thickness 214. The compressed thickness of the grid system will likely depend upon the amount of the downward force. However, in one embodiment, during a gait cycle, the grid system may be compressed 10%. In other words, when compressed 10%, the total thickness of the grid system 206 would be approximately 10% less than its decompressed thickness 214. In other embodiments, the grid system may compress approximately 20%, 25%, 30%, 35%, or 40% during a gait cycle. In other embodiments, the grid system may only compress approximately 5%.

As shown in FIGS. 8 and 9, according to some embodiments, the lattice structure 202, 222 includes protuberances 208, 228 which extend normally from a surface of the resilient web. These protuberances may extend out from two opposite surfaces of the resilient web as shown, or in other embodiments, the protuberances may only extend out from one surface. These protuberances may be rounded as shown in FIG. 8 or more angled or square-shaped as shown in FIG. 9. In one embodiment, the thickness 212, 232 of the protuberances is at least approximately the thickness 210, 230 of the resilient web. In some embodiments, the thickness of the protuberances is greater than the thickness of the resilient web.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An athletic shoe construction comprising:

a grid system located in the heel portion, the grid system forming a lattice pattern designed to resiliently support a foot and deflect downwardly upon foot imposed forces, wherein the grid system is constructed from a foamed compressible material;

a midsole defining an opening, the midsole arrayed about the periphery of the grid system and extending downwardly therefrom, such that the grid system can deflect and compress into the opening formed by the midsole.

2. The athletic shoe construction of claim 1, further comprising a base structure positioned below the grid system, wherein the base structure extends into the opening formed by the midsole.

3. The athletic shoe construction of claim 2, wherein the base structure is spaced apart from at least a portion of the grid system.

4. The athletic shoe construction of claim 2, wherein the base structure is positioned to limit the deflection of the grid system into the opening.

5. The athletic shoe construction of claim 1, further comprising a midsole insert, wherein the grid system is formed into the midsole insert.

6. The athletic shoe construction of claim 5, wherein the midsole insert extends from the heel portion through the midfoot and forefoot portions.

7. The athletic shoe construction of claim 1, wherein the midsole includes a plurality of independent supports arrayed about the periphery of the grid system, the supports including a ground engaging section and a resilient section intermediate the ground engaging section and the grid system, said supports collectively providing a flexible resilient support for the grid system.

8. The athletic shoe construction of claim 5, wherein the lattice pattern of the grid system is formed into both an upper surface and a lower surface of the midsole insert.

9. The athletic shoe construction of claim 8, wherein the lattice pattern of the grid system extends through the entire thickness of the midsole insert.

10. An athletic shoe construction comprising:

a grid system located in the heel portion, the grid system forming a lattice pattern designed to resiliently support a foot and deflect downwardly upon foot imposed forces, wherein the grid system is constructed from a compressible material;

a midsole defining an opening, the midsole arrayed about the periphery of the grid system wherein the grid system is positioned above the midsole and the midsole extends downwardly therefrom, such that the grid system can deflect and compress into the opening formed by the midsole.

11. The athletic shoe construction of claim 10, wherein the grid system is constructed from a foamed material.

12. The athletic shoe construction of claim 10, further comprising a base structure positioned below the grid system to limit the deflection of the grid system into the opening.

13. An athletic shoe construction comprising:

a grid system formed by a resilient web with a reinforcing lattice structure, the grid system designed to resiliently support a foot and deflect downwardly upon foot imposed forces, wherein the lattice structure is constructed from a foamed compressible material;

a midsole positioned below the grid system and defining an opening, the midsole arrayed about the periphery of the grid system and extending downwardly therefrom, such that the resilient web and lattice structure can deflect and compress, respectively, into the opening formed by the midsole.

14. The athletic shoe construction of claim 13, wherein the resilient web is integrally formed with the reinforcing lattice structure.

15. The athletic shoe construction of claim 13, further comprising a base structure positioned below the grid system to limit the deflection of the grid system into the opening.

16. The athletic shoe construction of claim 13, wherein the lattice structure includes protuberances which extend normally from a surface of the resilient web.

17. The athletic shoe construction of claim 16, wherein the thickness of the protuberances is at least approximately the thickness of the resilient web.

18. The athletic shoe construction of claim 16, wherein the lattice structure includes protuberances which extend normally from a second surface of the resilient web.

19. The athletic shoe construction of claim 13, wherein the resilient web is constructed from a compressible material.

* * * * *